US008844903B2

(12) United States Patent
Takahashi et al.

(10) Patent No.: US 8,844,903 B2
(45) Date of Patent: Sep. 30, 2014

(54) VALVE SEAT

(75) Inventors: Rintarou Takahashi, Kumagaya (JP); Hiroji Henmi, Kumagaya (JP)

(73) Assignee: Kabushiki Kaisha Riken, Tokyo (JP)

( * ) Notice: Subject to any disclaimer, the term of this patent is extended or adjusted under 35 U.S.C. 154(b) by 126 days.

(21) Appl. No.: 13/580,499

(22) PCT Filed: Feb. 21, 2011

(86) PCT No.: PCT/JP2011/053744

§ 371 (c)(1),
(2), (4) Date: Aug. 22, 2012

(87) PCT Pub. No.: WO2011/105338

PCT Pub. Date: Sep. 1, 2011

(65) Prior Publication Data

US 2012/0319026 A1 Dec. 20, 2012

(30) Foreign Application Priority Data

Feb. 23, 2010 (JP) ..... 2010-037386

(51) Int. Cl.

| | |
|---|---|
| ***F16K 25/00*** | (2006.01) |
| ***C22C 33/02*** | (2006.01) |
| ***C22C 38/12*** | (2006.01) |
| ***F01L 3/02*** | (2006.01) |
| ***C22C 38/02*** | (2006.01) |
| ***F01L 3/22*** | (2006.01) |
| ***C22C 27/04*** | (2006.01) |
| ***C22C 38/16*** | (2006.01) |
| *B22F 1/00* | (2006.01) |

(52) U.S. Cl.

CPC ..... *F01L 3/02* (2013.01); *F01L 2101/00* (2013.01); *C22C 33/02* (2013.01); *C22C 38/12* (2013.01); *B22F 2001/0066* (2013.01); *F01L 2103/00* (2013.01); *C22C 38/02* (2013.01); *F01L 3/22* (2013.01); *C22C 27/04* (2013.01); *C22C 38/16* (2013.01)

USPC ..... 251/368

(58) Field of Classification Search

USPC ..... 251/368

See application file for complete search history.

(56) References Cited

U.S. PATENT DOCUMENTS 6,139,599 A * 10/2000 Takahashi et al. ..... 75/246
7,089,902 B2 8/2006 Sato et al.

(Continued)

FOREIGN PATENT DOCUMENTS

CN 1837397 A 9/2006
JP 6-145916 A 5/1994

(Continued)

OTHER PUBLICATIONS

Extended European Search Report for European Application No. 11747299.3 dated Oct. 28, 2013.

(Continued)

*Primary Examiner* — John K Fristoe, Jr.
*Assistant Examiner* — Kevin E Lynn
(74) *Attorney, Agent, or Firm* — Birch, Stewart, Kolasch & Birch, LLP

(57) ABSTRACT

In a valve seat made of an iron-based, composite sintered alloy having hard particles and a solid lubricant dispersed therein to have high wear resistance and good machinability, which is usable in high-power fuel direct injection engines with improved fuel efficiency and low emission, relatively coarse solid lubricant particles in such an amount as not to drastically reduce the strength of a sintered body are dispersed to provide self-lubrication, and as fine solid lubricant particles as not hindering the bonding of matrix particles are dispersed to improve machinability.

5 Claims, 2 Drawing Sheets

(56) References Cited

U.S. PATENT DOCUMENTS

| | | | |
|---|---|---|---|
| 2002/0084004 | A1 | 7/2002 | Takahashi et al. |
| 2004/0187830 | A1 | 9/2004 | Sato et al. |

FOREIGN PATENT DOCUMENTS

| | | | |
|---|---|---|---|
| JP | 2000-73151 | A | 3/2000 |
| JP | 2000-199040 | A | 7/2000 |
| JP | 2002-129296 | A | 5/2002 |
| JP | 2002-220645 | A | 8/2002 |
| JP | 2003-166025 | A | 6/2003 |
| JP | 2006-299404 | | 11/2006 |

OTHER PUBLICATIONS

Chinese Office Action for corresponding Chinese Application No. 201180010500.8 dated Jul. 29, 2013 (with English translation).

* cited by examiner

VALVE SEAT

FIELD OF THE INVENTION

The present invention relates to a valve seat for internal engines, particularly to a valve seat made of an iron-based, composite sintered alloy, which is used under the condition of low lubrication by fuel injection into cylinders.

BACKGROUND OF THE INVENTION

For environmental protection, improved fuel efficiency, lower emission and higher power are increasingly needed to internal engines, and high-load combustion and high-load engine specification require combustion chamber parts to have higher wear resistance in a wide use temperature range. Valve seats used with intake valves and exhaust valves for keeping the gas tightness of combustion chambers are exposed to combustion pressure, and repeated shock by the motion of valves, needing wear resistance in a special environment. Particularly in fuel direct injection engines in which fuel is directly injected into each cylinder (cylinder bore), there is a hard lubrication condition in contact portions of valves and valve seats, because a fuel does not pass through them, and they are in a high-temperature environment because they are little cooled by the evaporation of a fuel. For valve seats for fuel direct injection engines, namely valve seats used under a hard lubrication condition at high temperatures, for example, JP 2003-166025 A discloses an iron-based, sintered alloy in which solid lubricants are dispersed to improve self-lubrication, and a high-alloy material having improved wear resistance at high temperatures.

However, the addition of solid lubricants in a predetermined amount or more reduces the strength of a sintered body, resulting in insufficient wear resistance at low temperatures.

Valve seats are required to have high finish precision in surfaces brought into contact with valves to secure gas tightness in combustion chambers, and excellent machinability for coaxial machining with valve guides after assembled to cylinders. However, valve seats are harder to machine than other parts constituting engines, because of high-hardness particles, etc. added to improve wear resistance, and so-called intermittent cutting due to voids in the sintered alloy, thereby reducing productivity in an engine-producing line. Thus, valve seats are required to have improved wear resistance and machinability.

OBJECT OF THE INVENTION

An object of the present invention is to provide a valve seat made of an iron-based, composite sintered alloy having high wear resistance and good machinability, which is usable in high-power fuel direct injection engines with improved fuel efficiency and low emission.

SUMMARY OF THE INVENTION

The present invention essentially uses solid lubricants not reducing the strength of a sintered body when added in predetermined amounts or more as described above. As a result of intensive research, the inventors have found that the dispersion of coarse solid lubricant particles in such an amount as not to drastically reduce the strength of a sintered body provides self-lubrication, and the dispersion of as fine solid lubricant particles as not hindering the bonding of matrix particles provides improved machinability.

Thus, the valve seat of the present invention is made of an iron-based, composite sintered alloy, in which hard particles and a solid lubricant are dispersed; said solid lubricant being composed of solid lubricant particles having different average particle sizes; at least coarse lubricant particles having an average particle size of 20-100 μm and fine lubricant particles having an average particle size of 2-10 μm, the amounts of said coarse lubricant particles and said fine lubricant particles being respectively 0.3% or more by volume, and their total amount being 10% or less by volume. Their total amount is preferably 1-5% by volume. It is preferable that 90% or more of fine lubricant particles having an average particle size of 2-10 μm have particle sizes of 0.5-15 μm, and that 90% or more of coarse lubricant particles having an average particle size of 20-100 μm have particle sizes of 10-120 μm. Particles constituting the matrix preferably have an average particle size of 45-150 μm.

The solid lubricant used in the valve seat of the present invention is preferably at least one solid lubricant selected from the group consisting of fluorides (LiF, $CaF_2$, $BaF_2$, etc.), sulfides (MnS, $MnS_2$, etc.) and boron nitride (BN). Namely, the coarse lubricant particles and the fine lubricant particles described above may be selected from the same species such as $CaF_2$, or different species such as $CaF_2$ and BN.

Hard particles used in the valve seat of the present invention are preferably Fe—Mo—Si alloy particles having a composition comprising, by mass, 40-70% of Mo, 0.4-2.0% of Si, and 0.1% or less of C, the balance being Fe and inevitable impurities, and an average particle size of 20-60 μm. The amount of hard particles dispersed is preferably 0.3-5% by volume, more preferably 0.5-2% by volume.

The matrix of the valve seat of the present invention preferably has a composition comprising, by mass, 0.4-2.0% of Si, 0.5-5% of Mo, 1-5% of Cu, and 0.5-2.5% of C, the balance being Fe and inevitable impurities. Its structure is preferably composed of a martensite phase and/or a pearlite phase.

BRIEF DESCRIPTION OF THE DRAWINGS

FIG. 1(*b*) is a graph showing the evaluation results of the valve seats of Examples (within the present invention) and Comparative Examples by wear rig tester at a test temperature of 250° C.

DESCRIPTION OF THE PREFERRED EMBODIMENTS

Figure 1A:
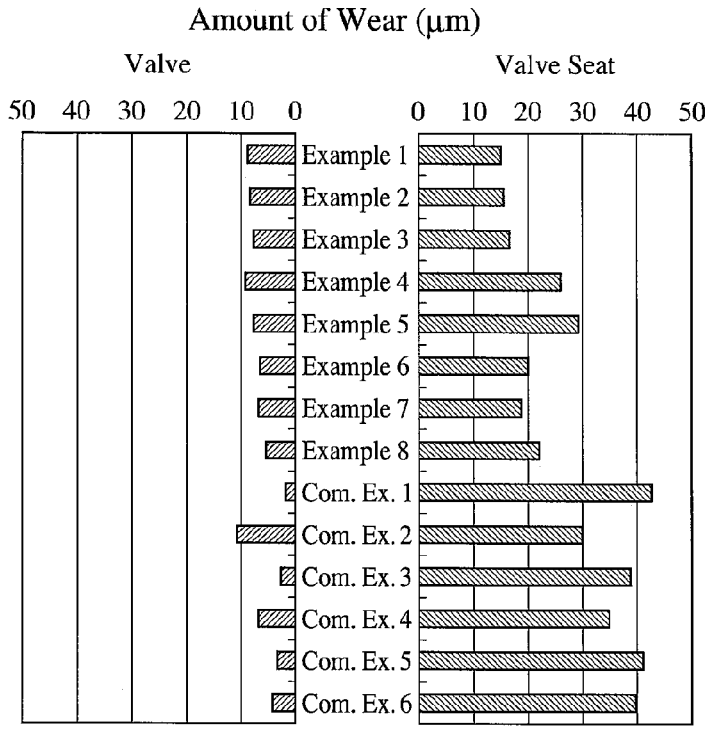
FIG. 1(*a*) is a graph showing the evaluation results of the valve seats of Examples (within the present invention) and Comparative Examples by a wear rig tester at a test temperature of 150° C.

The valve seat of the present invention made of an iron-based, composite sintered alloy is composed of a matrix, and a solid lubricant and hard particles dispersed in the matrix, said solid lubricant comprising solid lubricant particles having different average particle sizes; at least coarse lubricant particles having an average particle size of 20-100 μm and fine lubricant particles having an average particle size of 2-10 μm, each of said coarse lubricant particles and said fine lubricant particles being 0.3% or more by volume, and their total amount being 10% or less by volume. With respect to the coarse lubricant particles, the average particle size of less than 20 μm unlikely provides improved self-lubrication, and the average particle size exceeding 100 μm undesirably makes it difficult to compress the powder, resulting in extremely decreased strength, and low wear resistance due to the detachment of particles, etc. With respect to the fine lubricant particles, the average particle size of less than 2 μm makes the fine dispersion of lubricant particles difficult due to agglomeration, and the average particle size exceeding 10 μm undesirably increases the proportion of coarse lubricant particles rather than improving machinability, resulting in low strength. When the amounts of the coarse lubricant particles and the fine lubricant particles dispersed are respectively less than 0.3% by volume, sufficient self-lubrication and machinability are not achieved. And, their total amount exceeding 10% by volume undesirably decreases the strength of bonding particles, resulting in low wear resistance due to the detachment of particles, etc. The more preferred amount of the solid lubricant dispersed is 1-5% by volume.

The solid lubricant used in the valve seat of the present invention is preferably at least one solid lubricant selected from the group consisting of fluorides (LiF, $CaF_2$, $BaF_2$, etc.), sulfides (MnS, $MnS_2$, etc.) and boron nitride (BN). Namely, the fine lubricant particles and the coarse lubricant particles described above may be selected from the same species such as $CaF_2$, or different species such as $CaF_2$ and BN. A particularly preferred combination of the solid lubricants is coarse lubricant particles of $CaF_2$, and fine lubricant particles of MnS. When the fine lubricant particles and the coarse lubricant particles are selected from the same solid lubricant having peaks in 2-10 μm and 20-100 μm in its particle size distribution, these peak positions are regarded as corresponding to their average particle sizes.

The hard particles used in the valve seat of the present invention are preferably Fe—Mo—Si alloy particles composed of an intermetallic compound comprising, by mass, 40-70% of Mo, 0.4-2.0% of Si, and 0.1% or less of C, the balance being Fe and inevitable impurities. The Fe—Mo—Si alloy particles are so scarcely diffused in an iron-based matrix that they do not modify the matrix, thereby suppressing attackability on a mating member due to the modification of the matrix, and thus improving wear resistance. From the aspect of wear resistance and fracture toughness, the hard particles preferably have Vickers hardness of 600-1200 Hv and an average particle size of 20-60 μm. 90% or more of hard particles having an average particle size of 20-60 μm preferably have particle sizes of 5-150 μm. From the aspect of wear resistance and machinability, the amount of hard particles dispersed is preferably 0.3-5% by volume, more preferably 0.5-2% by volume.

The matrix preferably has a composition comprising, by mass, 0.4-2.0% of Si, 0.5-5% of Mo, 1-5% of Cu, and 0.5-2.5% of C, the balance being Fe and inevitable impurities. Si is an element contained in the matrix and hard particles and forming oxide films to improve wear resistance. Mo is an element improving hardenability and matrix strength for higher wear resistance. Cu is an element contained in the matrix and improving the hardness, strength and thermal conductivity, thereby providing improved wear resistance as well as improved self-lubrication due to soft metal characteristics. C is dissolved in the matrix for strengthening, and forms carbides with other alloy elements for higher wear resistance. 0.5-2.5% of C is preferable because it provides a martensitic and/or pearlitic structure, resulting in proper toughness and improved wear resistance. Starting materials for the matrix may be a mixture of iron powder and alloy metal powders, graphite powder, etc., or powder alloyed to a predetermined composition (we-alloyed powder). Preferably used are Fe—Mo—Si alloy powder, etc. comprising 2.5% of Mo and 1% of Si by mass.

The valve seat of the present invention is obtained by mixing various starting material powders for the above matrix, solid lubricant and hard particles in predetermined formulations, and press-molding, sintering, and heat-treating the resultant mixed powder. As a parting agent in the press molding, stearate, etc. may be added to the starting material powders. Sintering is conducted in a temperature range of 1050-1200° C. in vacuum or in a non-oxidizing (reducing) atmosphere. Tempering is conducted in a temperature range of 500-700° C. The sintering temperature of lower than 1050° C. provides insufficient diffusion bonding, failing to obtain necessary strength, and the sintering temperature exceeding 1200° C. causes abnormal diffusion between hard particles and the matrix, resulting in deteriorated wear resistance. The non-oxidizing (reducing) atmosphere is preferably $NH_3$, a mixed gas of $N_2$ and $H_2$, etc. Voids in the sintered body may be sealed with a resin, etc.

The amounts of the solid lubricant and the hard particles dispersed, an important feature of the present invention, are expressed by "% by volume." Because their volume percentages are statistically the same as their area percentages in a cross section of the sintered body, the volume percentages can be determined by the image analysis of a photograph of an optical microscope or a scanning electron microscope showing a cross section structure of the sintered body. It should be noted that because the sintered body of the present invention has voids, "% by volume" used herein is a percentage based on 100% of a region free from voids.

EXAMPLES 1-8 (J1 TO J8) AND COMPARATIVE EXAMPLES 1-6 (H1 TO H6)

Pre-alloyed powder [Fe—$Mo_{2.5}$—$Si_{1.0}$ alloy powder (% by mass)] having peaks in 75-100 μm in its particle size distribution was mixed and blended with electrolytic Cu powder, solid lubricant powders ($CaF_2$ having an average particle size of 35 μm, MnS having an average particle size of 5 μm, hexagonal BN having an average particle size of 7 μm, and hexagonal BN having an average particle size of 55 μm), hard particle powder [ferromolybdenum silicon powder having a composition of Fe—$Mo_{60}$—$Si_1$ (% by mass) and an average particle size of 45 μm], and graphite powder in formulations shown in Table 1. Each of the resultant mixed powders was charged into a press-molding die, compression-molded by pressing, and sintered at 1120° C. in vacuum to obtain a ring-shaped, sintered body having an outer diameter of 37.6 mm, an inner diameter of 26 mm and a thickness of 8 mm. Thereafter, a tempering heat treatment was conducted at 650° C. All formulations shown in Table 1 are expressed by "% by mass."

TABLE 1

| | Solid Lubricant | | | | | | | | |
|---|---|---|---|---|---|---|---|---|---|
| | Coarse Lubricant Particles | | Fine Lubricant Particles | | Hard Particles Fe—Mo—Si | Matrix Fe—Si—Mo—Cu—C | | | |
| No. | Type | Amount %*1 | Type | Amount %*1 | Amount %*1 | C %*1 | Si %*1 | Mo %*1 | Cu %*1 |
| J1 | $CaF_2$ | 0.25 | MnS | 0.25 | 1.5 | 1.1 | 1.2 | 2.5 | 3.0 |
| J2 | $CaF_2$ | 0.5 | MnS | 0.5 | 1.5 | 1.1 | 1.2 | 2.5 | 3.0 |
| J3 | $CaF_2$ | 1.0 | MnS | 1.0 | 1.5 | 1.1 | 1.2 | 2.5 | 3.0 |

TABLE 1-continued

| | Solid Lubricant | | | | | | | | |
|---|---|---|---|---|---|---|---|---|---|
| | Coarse Lubricant Particles | | Fine Lubricant Particles | | Hard Particles Fe—Mo—Si | Matrix Fe—Si—Mo—Cu—C | | | |
| No. | Type | Amount %*1 | Type | Amount %*1 | Amount %*1 | C %*1 | Si %*1 | Mo %*1 | Cu %*1 |
| J4 | $CaF_2$ | 1.5 | MnS | 2.5 | 1.5 | 1.1 | 1.2 | 2.5 | 3.0 |
| J5 | $CaF_2$ | 2 | MnS | 2.5 | 1.5 | 1.1 | 1.2 | 2.5 | 3.0 |
| J6 | BN*2 | 0.5 | BN*3 | 0.5 | 1.5 | 1.1 | 1.2 | 2.5 | 3.0 |
| J7 | BN*2 | 1.0 | BN*3 | 0.4 | 1.5 | 1.1 | 1.2 | 2.5 | 3.0 |
| J8 | $CaF_2$ | 0.5 | MnS | 0.5 | 1.5 | 1.1 | 1.2 | 1.0 | 3.0 |
| H1 | $CaF_2$ | 3 | MnS | 0 | 1.5 | 1.1 | 1.2 | 2.5 | 3.0 |
| H2 | $CaF_2$ | 3 | MnS | 0 | 3.5 | 1.8 | 0.8 | 1.0 | 1.0 |
| H3 | $CaF_2$ | 3 | MnS | 0.1 | 1.5 | 1.1 | 1.2 | 2.5 | 3.0 |
| H4 | $CaF_2$ | 0 | MnS | 2.5 | 1.5 | 1.1 | 1.2 | 2.5 | 3.0 |
| H5 | $CaF_2$ | 3 | MnS | 2.5 | 1.5 | 1.1 | 1.2 | 2.5 | 3.0 |
| H6 | BN*2 | 1.5 | BN*3 | 2.5 | 1.5 | 1.1 | 1.2 | 2.5 | 3.0 |

Note:
*1% by mass.
*2Hexagonal BN having an average particle size of 55 μm.
*3Hexagonal BN having an average particle size of 7 μm.

The resultant sintered bodies were ground, and their structures were observed by an optical microscope or a scanning electron microscope. The structures were identified using element analysis, etc., if necessary, and the percentages by volume of the solid lubricant and the hard particles were measured by image analysis. The percentages by volume of the solid lubricant and the hard particles were calculated, assuming that a structure region excluding voids was 100%. In the present invention, voids were in a range of 7-12% by volume. The etched matrix structure was also observed. The image analysis was conducted on a photograph (magnification: 100 times) of the structure. The results are shown in Table 2.

TABLE 2

| | Solid Lubricant | | | | | |
|---|---|---|---|---|---|---|
| | Coarse Lubricant Particles | | Fine Lubricant Particles | | Hard Particles Fe—Mo—Si | Matrix Fe—Si—Mo—Cu—C |
| No. | Type | Vol. % | Type | Vol. % | (Vol. %) | Structure (P*1, M*2, or P + M) |
| J1 | $CaF_2$ | 0.6 | MnS | 0.5 | 1.0 | P + M |
| J2 | $CaF_2$ | 1.2 | MnS | 1.3 | 0.9 | P + M |
| J3 | $CaF_2$ | 2.4 | MnS | 1.9 | 0.8 | P + M |
| J4 | $CaF_2$ | 3.5 | MnS | 4.7 | 0.7 | P + M |
| J5 | $CaF_2$ | 4.7 | MnS | 4.7 | 0.6 | P + M |
| J6 | BN | 1.8 | BN | 1.7 | 0.9 | P + M |
| J7 | BN | 3.5 | BN | 1.4 | 0.8 | P + M |
| J8 | $CaF_2$ | 1.2 | MnS | 1.3 | 0.9 | P |
| H1 | $CaF_2$ | 7.1 | MnS | 0 | 0.7 | P + M |
| H2 | $CaF_2$ | 7.1 | MnS | 0 | 1.7 | M |
| H3 | $CaF_2$ | 7.1 | MnS | 0.2 | 0.7 | P + M |
| H4 | $CaF_2$ | 0 | MnS | 4.8 | 0.8 | P + M |
| H5 | $CaF_2$ | 6.9 | MnS | 4.6 | 0.6 | P + M |
| H6 | BN | 4.9 | BN | 8.2 | 0.5 | P + M |

Note:
*1Pearlite.
*2Martensite.

Figure 1B:
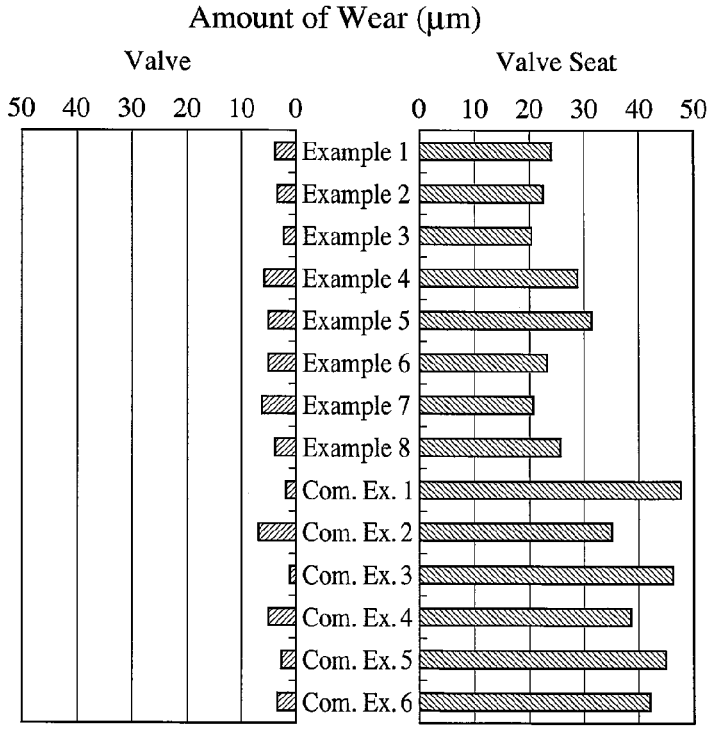
Figure 3:
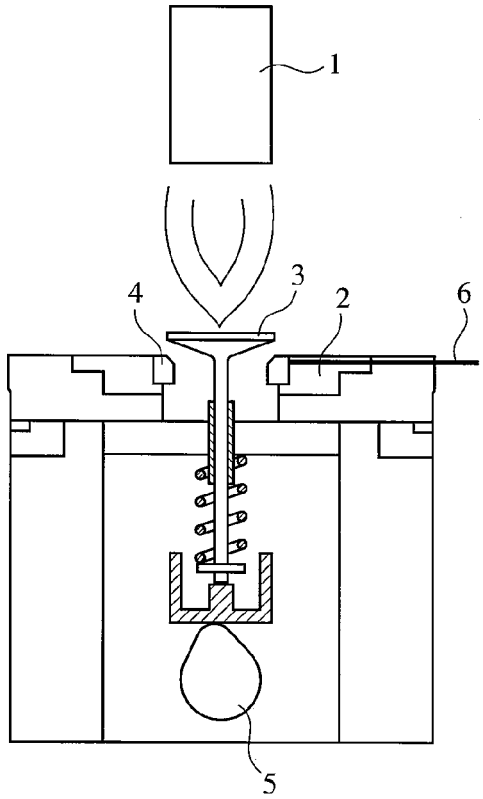
FIG. 3 is a schematic view showing a wear rig tester.

Each of the resultant sintered bodies was machined to a valve seat, whose wear resistance was evaluated by a wear rig tester shown in FIG. 3. A wear rig test is conducted by setting a valve seat 4 press-fitted in a member 2 corresponding to a cylinder head in the tester, and reciprocating the valve 3 vertically by the rotation of a cam 5 while heating the valve 3 and the valve seat 4 by a burner 1. With a thermocouple 6 embedded in the valve seat 4, the burner 1 is controlled such that a contact surface of the valve seat is adjusted to a predetermined temperature. Wearing occurs in the valve seat 4 repeatedly impinged by the valve 3. The amount of wear was calculated from the shapes of the valve seat and the valve measured before and after the test. The valve used was made of an SUH alloy (JIS G 4311) having a size fitting to the above valve seat. As test conditions, the temperature of the valve seat contact surface was 150° C. and 250° C., the rotation speed of the cam was 2500 rpm, and the test time was 5 hours. The test results are shown in Table 3, FIG. 1(*a*) at a test temperature 150° C., and FIG. 1(*b*) at a test temperature 250° C.

TABLE 3

| | Amount of Wear (μm) | | | | | |
|---|---|---|---|---|---|---|
| | Tested at 150° C. | | | Tested at 250° C. | | |
| No. | Valve Seat | Valve | Total | Valve Seat | Valve | Total |
| J1 | 15.0 | 8.8 | 23.8 | 24.0 | 4.0 | 28.0 |
| J2 | 15.5 | 8.5 | 24.0 | 22.5 | 3.5 | 26.0 |
| J3 | 16.5 | 7.5 | 24.0 | 20.4 | 2.5 | 23.0 |
| J4 | 26.0 | 9.0 | 35.0 | 29.0 | 6.0 | 35.0 |
| J5 | 29.0 | 7.8 | 36.8 | 31.2 | 5.2 | 36.4 |
| J6 | 20.2 | 6.3 | 26.5 | 23.1 | 4.9 | 28.0 |
| J7 | 18.8 | 7.0 | 25.8 | 20.9 | 6.3 | 27.3 |
| J8 | 22.1 | 5.3 | 27.4 | 25.6 | 4.1 | 29.7 |
| H1 | 42.3 | 2.0 | 44.3 | 47.8 | 1.8 | 49.6 |
| H2 | 30.0 | 10.5 | 40.5 | 35.1 | 7.0 | 42.1 |
| H3 | 39.0 | 2.5 | 41.5 | 46.5 | 1.0 | 47.5 |
| H4 | 35.0 | 6.8 | 41.8 | 38.7 | 5.2 | 43.9 |
| H5 | 41.0 | 3.3 | 44.3 | 45.0 | 2.8 | 47.8 |
| H6 | 39.5 | 4.1 | 43.6 | 42.2 | 3.5 | 45.7 |

In Examples 1-8 within the scope of the present invention, the amount of wear was 15-29 μm in the valve seat and 5.3-9 μm in the valve (mating member) at a test temperature of 150° C., and 20.4-31.2 μm in the valve seat and 2.5-6.3 μm in the valve (mating member) at a test temperature of 250° C., both exhibiting excellent wear resistance and low attackability to a mating member. On the other hand, in Comparative Examples 1 and 2 using only coarse lubricant particles, Comparative Example 3 using too small an amount of fine lubricant particles, Comparative Example 4 using only fine lubricant particles, and Comparative Examples 5 and 6 using too large amounts of lubricants, the valve seats suffered more wear than Examples at both test temperatures of 150° C. and 250° C. In Comparative Example 2 using a relatively large amount of hard particles and having a high-hardness matrix with a martensitic structure, the valve seat was a little worn while wearing the valve (mating member), and poor in a machinability test as described below.

Figure 2:
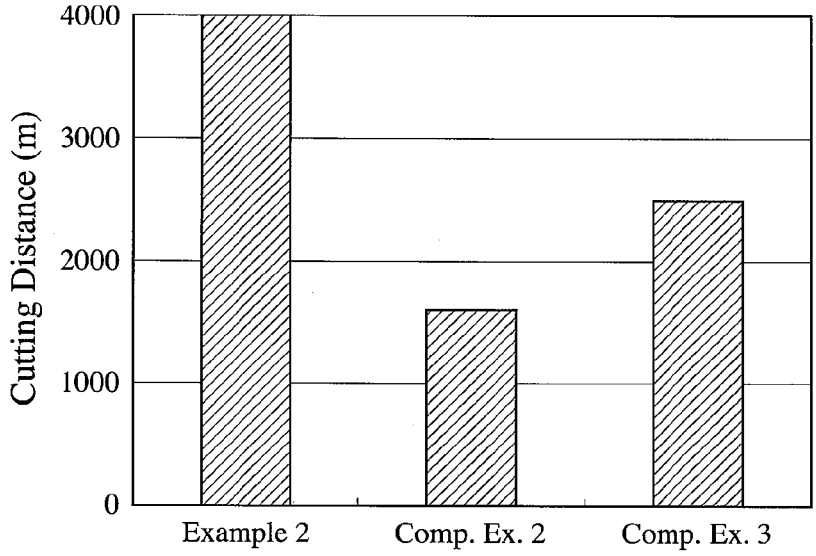
FIG. 2 is a graph showing the evaluation results of machinability (cutting distance until the cutting tool was worn to a predetermined depth) of the valve seats of Examples (within the present invention) and Comparative Examples.

In Example 2 and Comparative Examples 2, 3, large numbers of ring-shaped sintered bodies were produced, and their machinability was evaluated by cutting their end surfaces with a cutting tool moving from the outer peripheral side to the inner peripheral side in a lathe. The test was conducted at 730 rpm, a cutting depth of 0.3 mm and a feed speed of 0.05 mm/rev, under a dry condition, using a cemented carbide tool as a cutting tool. The machinability was evaluated by cutting distance and the roughness of a cut surface when the amount of wear of the tool reached a predetermined depth. The test results are shown in FIG. 2.

In Example 2 within the present invention, the cutting distance was 4000 m or more until the wear of a tool flank reached a predetermined amount. The cutting distance was 1600 m in Comparative Example 2 using a conventional material in which only coarse lubricant particles were dispersed, and 2500 m in Comparative Example 3 in which only 0.2% by volume of fine lubricant particles were added. With respect to the roughness of a cut surface, Example 2 within the present invention was better than Comparative Examples 2 and 3.

EFFECTS OF THE INVENTION

The valve seats of the present invention are satisfactory in both wear resistance and machinability, because the dispersions of relatively coarse solid lubricant particles in an amount not drastically reducing the strength of a sintered body provides self-lubrication, and the dispersions of fine solid lubricant particles in an amount not hindering the bonding of matrix particles provides improved machinability. Accordingly, when used in fuel direct injection engines, they exhibit excellent durability in a wide temperature range under a low lubricating condition. The valve seats of the present invention are particularly preferable as intake valve seats.

What is claimed is:

1. A valve seat made of an iron-based, composite sintered alloy, in which hard particles and a solid lubricant are dispersed, said solid lubricant comprising solid lubricants having different average particle sizes; at least coarse lubricant particles having an average particle size of 20-100 μm and fine lubricant particles having an average particle size of 2-10 μm, the amounts of said coarse lubricant particles and said fine lubricant particles being respectively 0.3% or more by volume, and their total amount being 10% or less by volume, wherein said hard particles are Fe—Mo—Si alloy particles having an average particle size of 20-60 μm, which comprise by mass 40-70% of Mo, 0.4-2.0% of Si, and 0.1% or less of C, the balance being Fe and inevitable impurities, and wherein the amount of said hard particles is 0.3-5% by volume.

2. The valve seat made of an iron-based, composite sintered alloy according to claim 1, wherein said solid lubricant is at least one selected from the group consisting of fluorides, sulfides and boron nitride, and wherein the amount of said solid lubricant dispersed is 1-5% by volume.

3. The valve seat made of an iron-based, composite sintered alloy according to claim 1 or 2, wherein the amount of said hard particles is 0.5-2.0% by volume.

4. The valve seat made of an iron-based, composite sintered alloy according to claim 1, wherein a matrix, in which said hard particles and said solid lubricant are dispersed, comprises by mass 0.4-2.0% of Si, 0.5-5% of Mo, 1-5% of Cu, and 0.5-2.5% of C, the balance being Fe and inevitable impurities.

5. The valve seat made of an iron-based, composite sintered alloy according to claim 4, wherein said matrix has a martensite phase and/or a pearlite phase.

* * * * *